US007770585B2

(12) United States Patent
Fowles

(10) Patent No.: US 7,770,585 B2
(45) Date of Patent: Aug. 10, 2010

(54) ADDITIVE APPLICATOR

(75) Inventor: Lawrence Fowles, South Yorkshire (GB)

(73) Assignee: C.B. Kaymich & Co. Limited, Sheffield (GB)

( * ) Notice: Subject to any disclaimer, the term of this patent is extended or adjusted under 35 U.S.C. 154(b) by 749 days.

(21) Appl. No.: 11/658,797

(22) PCT Filed: Jul. 20, 2005

(86) PCT No.: PCT/GB2005/002851

§ 371 (c)(1),
(2), (4) Date: Jan. 24, 2007

(87) PCT Pub. No.: WO2006/010895

PCT Pub. Date: Feb. 2, 2006

(65) Prior Publication Data

US 2008/0308114 A1 Dec. 18, 2008

(30) Foreign Application Priority Data

Jul. 30, 2004 (GB) ..... 0417068.4

(51) Int. Cl.
*A24C 1/32* (2006.01)

(52) U.S. Cl. ..... 131/88; 131/331; 493/49

(58) Field of Classification Search ..... 131/88, 131/331; 493/49

See application file for complete search history.

(56) References Cited

U.S. PATENT DOCUMENTS

| | | | | |
|---|---|---|---|---|
| 3,371,000 | A * | 2/1968 | Davenport et al. | 131/88 |
| 3,485,208 | A * | 12/1969 | Hemming et al. | 131/362 |
| 4,476,807 | A | 10/1984 | Pryor et al. | |
| 4,549,875 | A | 10/1985 | Pryor et al. | |
| 4,768,526 | A | 9/1988 | Pryor et al. | |
| 4,770,193 | A * | 9/1988 | Pryor | 493/49 |
| 5,387,285 | A * | 2/1995 | Rivers | 493/49 |
| 2003/0224918 | A1 | 12/2003 | Lanier et al. | |

FOREIGN PATENT DOCUMENTS

| | | |
|---|---|---|
| EP | 0573279 | 12/1993 |
| EP | 1397965 | 3/2004 |

* cited by examiner

*Primary Examiner*—Kahnh Nguyen
*Assistant Examiner*—John Blades
(74) *Attorney, Agent, or Firm*—Alleman Hall McCoy Russell & Tuttle LLP

(57) ABSTRACT

Apparatus for applying an additive to cigarette filter tow material which is in, or exiting, a filter tow funnel, the apparatus comprising a flavor inlet, a valve, and a hollow needle positioned downstream of at least a portion of said filter tow funnel, the needle being in fluid communication controlled by said valve with said flavor inlet, whereby, in use, a flavoring is delivered by said needle into the path of said filter tow material.

7 Claims, 8 Drawing Sheets

ADDITIVE APPLICATOR

CROSS-REFERENCE TO RELATED APPLICATIONS

This is the U.S. national phase of International PCT application Ser. No. PCT/GB2005/002851 filed Jul. 20, 2005, which in turn claims priority to GB Patent application Ser. No. 0417068.4 filed Jul. 30, 2004, both of which applications are hereby incorporated by reference in their entirety for all purposes.

This invention relates to the field of apparatus and methods for applying an additive to a cigarette filter and to cigarettes incorporating such filters.

Although the present invention is described with reference to the addition of flavouring to a cigarette filter, the invention is equally relevant to the application of other additives, for example those which may affect the burn characteristics of the cigarette.

Several methods are known of adding flavouring to cigarette filters. GB 1342931 (British-American Tobacco Limited) describes a method of injecting additives using a needleless injection technique known from the medical field.

GB2229078 (Rothmans International Tobacco UK Limited) describes a method of applying flavour or additive to one or more faces of the wrapping paper which contains the filter material ("tow"). This has the disadvantage of the flavour being located at the surface of a barrier (the paper) which prevents distribution of the flavour within the filter material.

WO 02/069745 (Philip Morris Products, Inc) describes a cigarette having a multi-component filter, one part of which comprises a flavour-releasing segment. This arrangement is relatively complex and therefore expensive to manufacture.

GB2236656 (Rothmans International Tobacco UK Limited) describes a process for producing a flavoured cigarette filter, in which a carrier is impregnated with a liquid flavour concentrate. It is suggested that the flavour concentrate, in the form of solid granules should be mixed into the tow, which is then used in conventional fashion to make cigarette filters. Little further technical detail of how the granules are mixed with the tow, in practice, is described in the patent application and various technical difficulties are envisaged. For example, typically, the filter-making apparatus would be used for manufacturing both flavoured and non-flavoured filters. Loose flavoured granules are likely to contaminate the apparatus, which will then require cleaning before non-flavoured filters or differently-flavoured filters can be manufactured. Furthermore it is difficult to regulate the dose of flavour being introduced into any particular length of finished filter rod.

With reference to FIG. 1, US2003/0224918A1 (Philip Morris USA Inc) attempts to mitigate these problems by providing a filter making apparatus in which the flavour is more precisely positioned within the tow material. There is provided a positioning device 1 with a passageway therethrough into which liquid flavourant is supplied. A continuous strand of textile material 2 is guided through the passageway so that it becomes saturated with the flavourant. A portion of the positioning device 1*a* then guides the continuous strand of textile material into the path of filter tow material 3 that is being converged around it, as it exits tow funnel 6 into tongue 7, to form a cigarette filter rod.

The finished filter therefore comprises compressed filter tow material surrounding an approximately centrally-placed strand of flavoured textile material. The positioning and accuracy of the dose of the flavour is thus improved, compared with the prior art methods described above.

However, the method described in US2003/0224918A1 suffers from several potential disadvantages:

- the flavoured textile strand is visible in the finished product, which may lead the smoker to view this as a flaw;
- there is a possibility that the smoker may dislodge the strand from the filter during inhalation;
- the dose of flavour which can be applied is limited by the absorbency characteristics of the textile strand;
- it is undesirable to place anything (such as the positioning device) in the path of the forward-moving tow material because of the risk of impeding or disrupting its flow, leading to defective product.

U.S. Pat. No. 4,549,875 describes a method for applying a smoke modifying agent into the filter tow stream at the point where the filter rod is formed by introducing a needle through which the smoke modifying agent is applied. This technique has the disadvantage that the needle can form an obstruction or operator hazard when the filter making machine needs to be reset or maintained for example due to tow breakage, tow pallet changeover or machine stoppage.

It is therefore an object of the present invention to provide a method and apparatus for applying a liquid additive to a filter which seeks to alleviate the above-described disadvantages.

According to a first aspect of the invention there is provided apparatus for applying an additive to cigarette filter tow material which is in, or exiting, a filter tow funnel, the apparatus comprising:

- a flavour inlet;
- a valve; and
- a hollow needle positioned downstream of at least a portion of said filter tow funnel, the needle being in fluid communication controlled by said valve with said flavour inlet,
- whereby, in use, an additive is delivered by said needle into the path of said filter tow material.

The use of a needle to apply the additive to the tow material enables the additive to be placed precisely within the tow, preferably as close to the centre line of the moving tow as possible. In this way, the additive is fully enclosed by the tow moving around it and the additive can be evenly and cleanly incorporated into the tow material. The risk of other apparatus in the production line being contaminated by the additive is minimised as the additive is fully enclosed within the needle or other parts of the apparatus of the invention throughout, until being delivered into the heart of the tow material.

Contrary to the expectation that it would be undesirable to place anything in the path of the moving tow, the use of the needle does not adversely affect the flow of the tow.

The prior art disadvantages associated with the use of a flavoured textile strand are eliminated.

Preferably, the needle is selectively moveable along a longitudinal axis between a forward position, in which at least the distal end of the needle is in the path of the filter tow material, and a retracted position, in which said needle is not in the path of said tow material. The option of retracting the needle enables operators to work on the apparatus, for example during setting-up procedures, without risk of needle stick injury. Correspondingly, the needle itself is protected from damage when in the retracted position.

Preferably, said longitudinal axis is substantially parallel with a tapered inner surface of said tow funnel. The tapered inner surface of the tow funnel determines and guides the path of the moving tow material. Moving the needle into the tow along an axis substantially parallel with the inner surface of the tow funnel, or preferably substantially parallel to the centre line of the flow path of said tow, allows the needle to enter the tow at an angle which minimises disruption to the flow path, both upon entry of the needle and when in use with the tow flowing around the needle.

Preferably, said needle is selectively moveable between said forward and retracted positions by said valve which is preferably pneumatically-operated.

Preferably, the orifice at the distal end of the needle is in the range 0.5 mm-1.0 mm.

In a preferred form, the apparatus further comprises heating means. Heating means can be used to ensure the additive remains in a liquid state during its passage through the apparatus.

Preferably, said additive is provided in solid form and melted into a liquid during passage through the apparatus.

Preferably, the delivery of additive to the flavour inlet is regulated by additive metering means. Use of the needle in combination with additive metering means enables a carefully controlled dose of additive to be supplied, taking into account the speed of the tow, the desired strength of dose, the size of the needle orifice and other factors.

Preferably, the passage of additive from the flavour inlet to the needle is controlled by said valve.

Ideally, said valve is provided with one or more O-ring seals.

In a preferred embodiment, said additive is a flavour.

According to a second aspect of the invention, there is provided a method of applying additive to a cigarette filter, comprising the steps of:

providing apparatus as described in any of the preceding paragraphs;

supplying an additive to said flavour inlet;

actuating said valve so as to move said valve and said needle into the forward position, into the path of tow material which is in, or exiting a tow funnel;

delivering additive via said needle into the tow.

Preferably, the method further comprises the step of heating all or part of the apparatus to ensure the additive is in liquid form.

According to a third aspect of the invention, there is provided a cigarette filter manufactured according to the method of or using the apparatus as described in any of the preceding paragraphs.

According to a fourth aspect of the invention, there is provided a cigarette incorporating a filter as described in the preceding paragraph.

Preferred embodiments of the present invention will now be more particularly described, by way of example only, with reference to the accompanying drawings in which.

Figure 1:
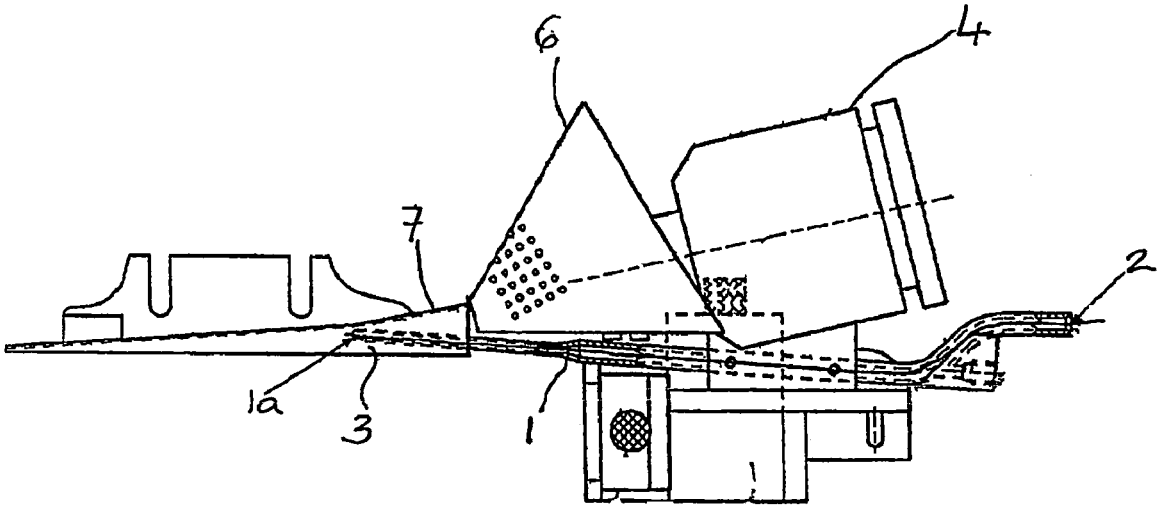
FIGURE 1 (PRIOR ART)
FIG. 1 (PRIOR ART) is a side elevation view of part of the apparatus of US2003/0224918A1.
Figure 2:
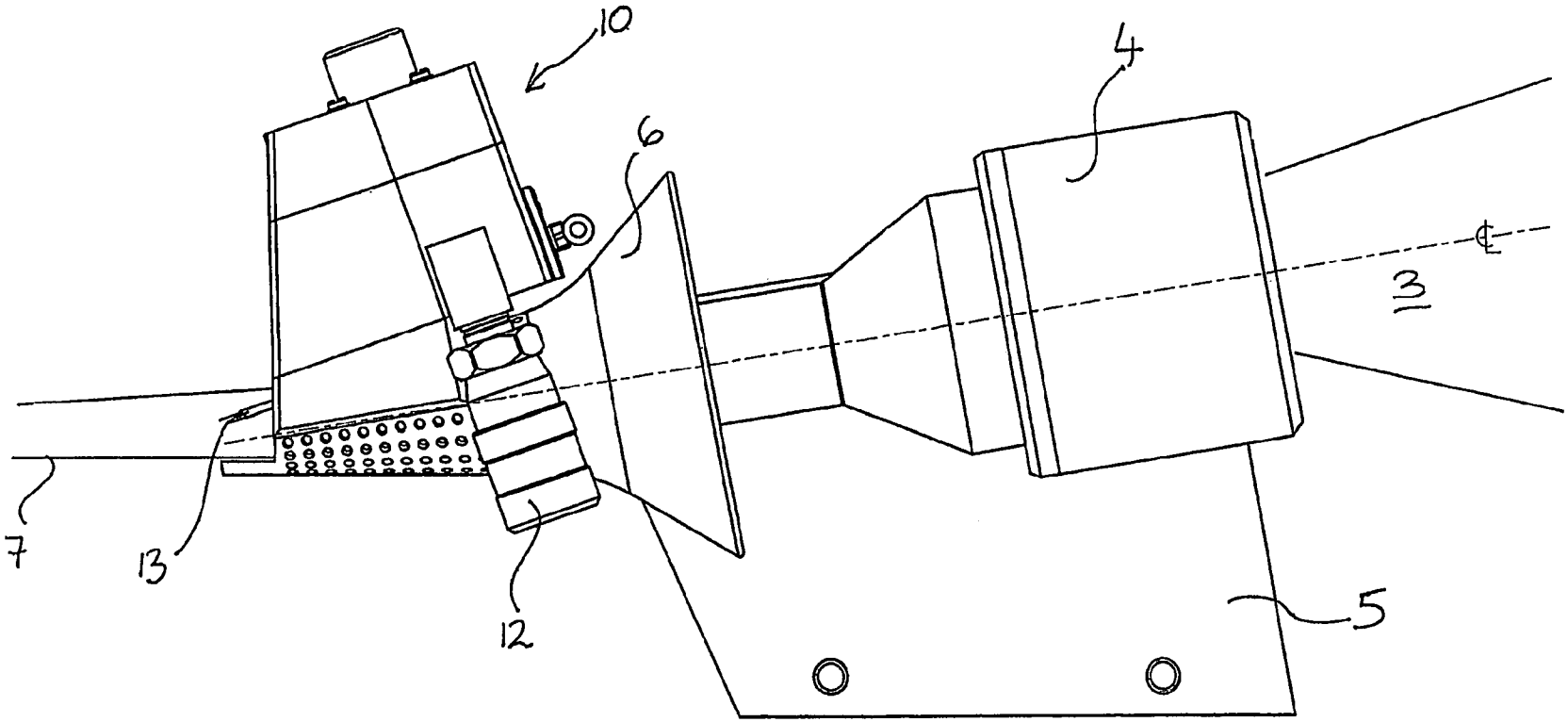
FIG. 2 is a side elevation view of the apparatus embodying the first aspect of the present invention.
Figure 3:
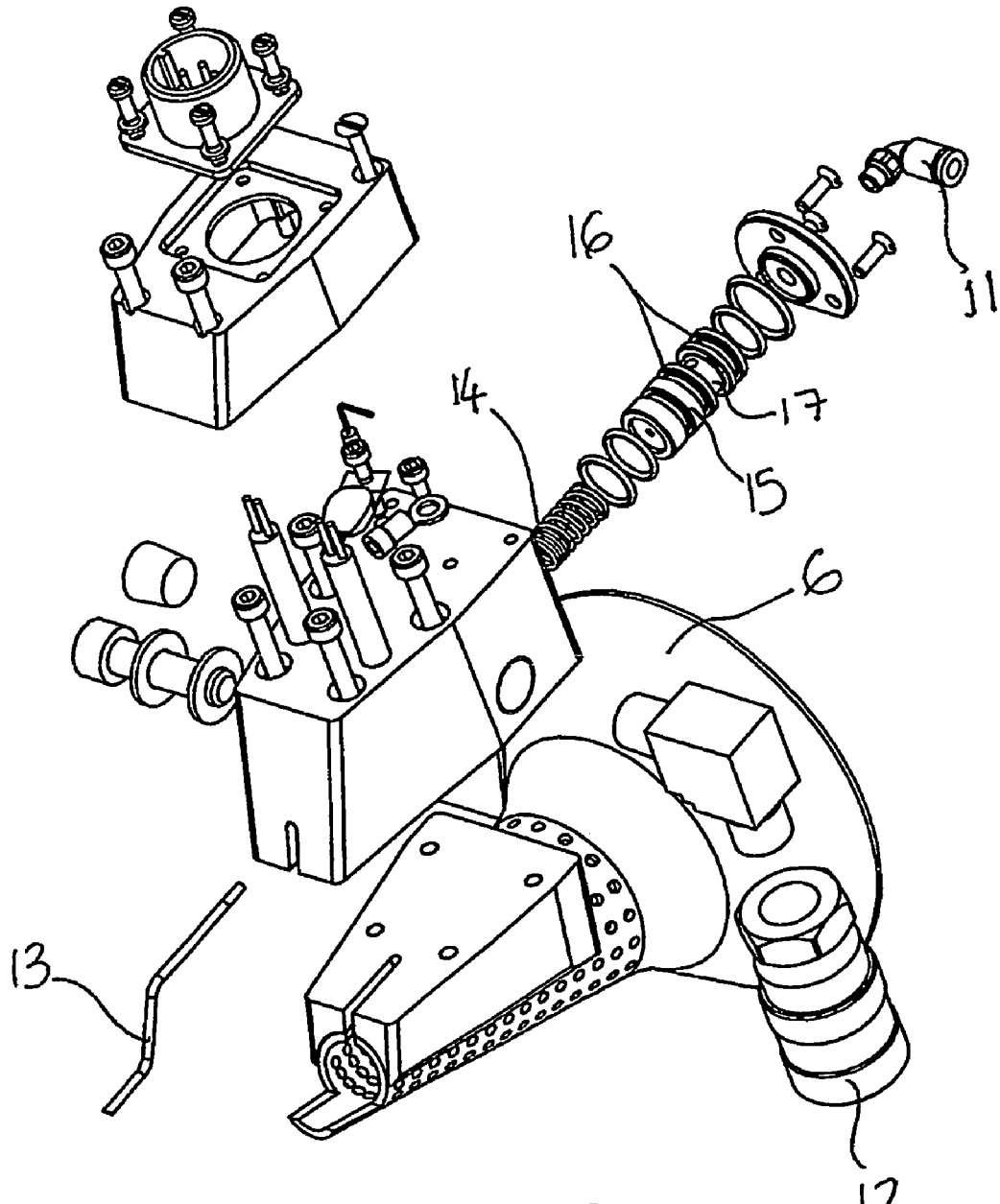
FIG. 3 is an exploded view of part of the apparatus.

With reference to FIG. 2, the conventional parts of the apparatus are identified as follows. Tow filter material 3 is delivered to the apparatus from an adjacent processing machine in the production line. The tow 3 is delivered into the rear of a stuffer jet assembly 4 which is mounted at an angle on a stuffer jet assembly mounting bracket 5.

The relatively loose-fibred tow 3 is channelled into a tow funnel 6 where it is compressed and guided into a rod of narrowed diameter by the time it exits the end of tongue 7 at the downstream end of the tow funnel 6.

Additive (in this case, flavour) applicator apparatus according to the first aspect of the present invention is also illustrated in FIG. 2. The flavour applicator assembly 10 is mounted in the region of the tow funnel 6.

Liquid flavour is applied to the tow by means of a hollow needle 13. As can be seen most clearly in FIGS. 4 and 5, the needle is not linear, but is shaped as shown. Preferably, the needle 13 comprises three sections—a proximal section 13A which is the upstream end, an angled centre section 13B, and a distal section 13C which is the downstream end. The distal section 13C is preferably relatively short and is substantially parallel to the proximal section 13A.

The needle 13 is moveable between two positions—a retracted position (see FIG. 4) wherein it is wholly retained inside the flavour applicator assembly 10, and a forward position (see FIG. 5) wherein at least the distal end 13C of the needle is positioned within the flow path of the tow material 3. A hydraulically or pneumatically operated spring 14 moves the needle between the two positions on demand.

Figure 4:
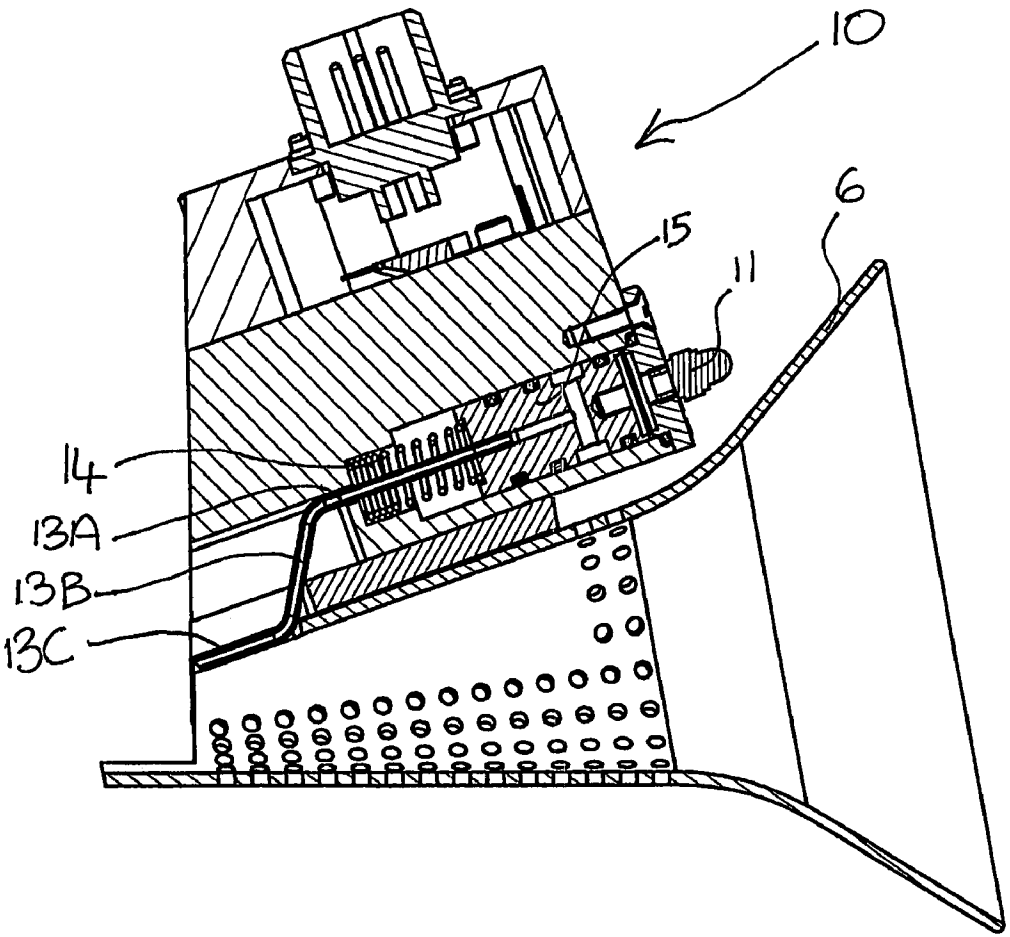
FIG. 4 is a cross-sectional side view of part of FIG. 2, with the needle in the retracted position.

The needle 13 is mounted to a spool valve 15. With reference to FIG. 4, in the retracted position, the spool valve 15 and hence needle 13 is biased rearwardly (upstream) by a spring 14.

Figure 5:
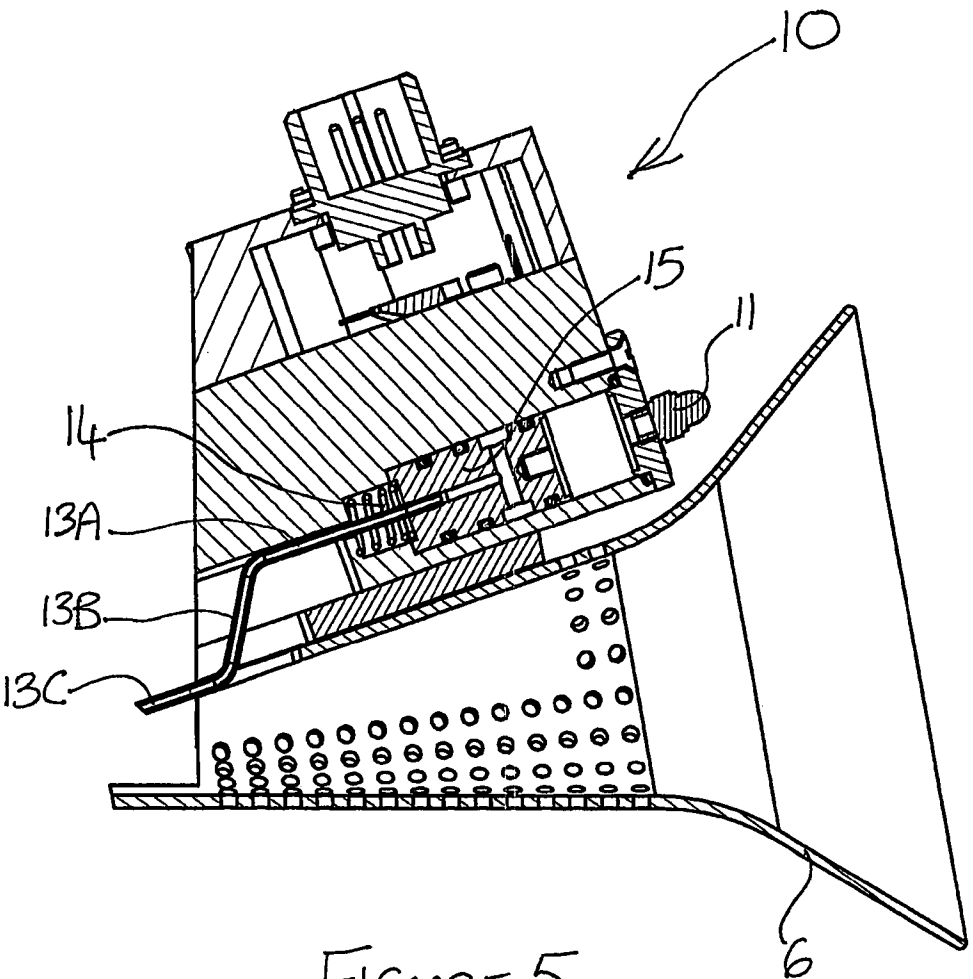
FIG. 5 is a cross-sectional side view of part of FIG. 2, with the needle in the forward position.

Upon supply of compressed air to an air inlet 11, the spool valve 15 and needle 13 are pushed forwardly (downstream), against the action of spring 14, to the forward position illustrated in FIG. 5. In this position, the distal end 13C of the needle moves through a slot (not shown) in the housing of the flavour applicator assembly 10 and protrudes into the flow path of the tow. In this position, the apparatus is ready to deliver flavour into the tow.

Flavour is supplied to the flavour applicator assembly 10 via a flavour inlet 12 which is coupled to a universal flavour applicator (additive metering means) of known, type (not illustrated), for example the UFA1000 flavour applicator manufactured by CB Kaymich & Co. Limited. The additive metering means is designed for use with many types of cold or heated flavours, such as menthol (crystal or solution), mint, fruit, clove, vanilla, liqueurs etc.

Figure 6:
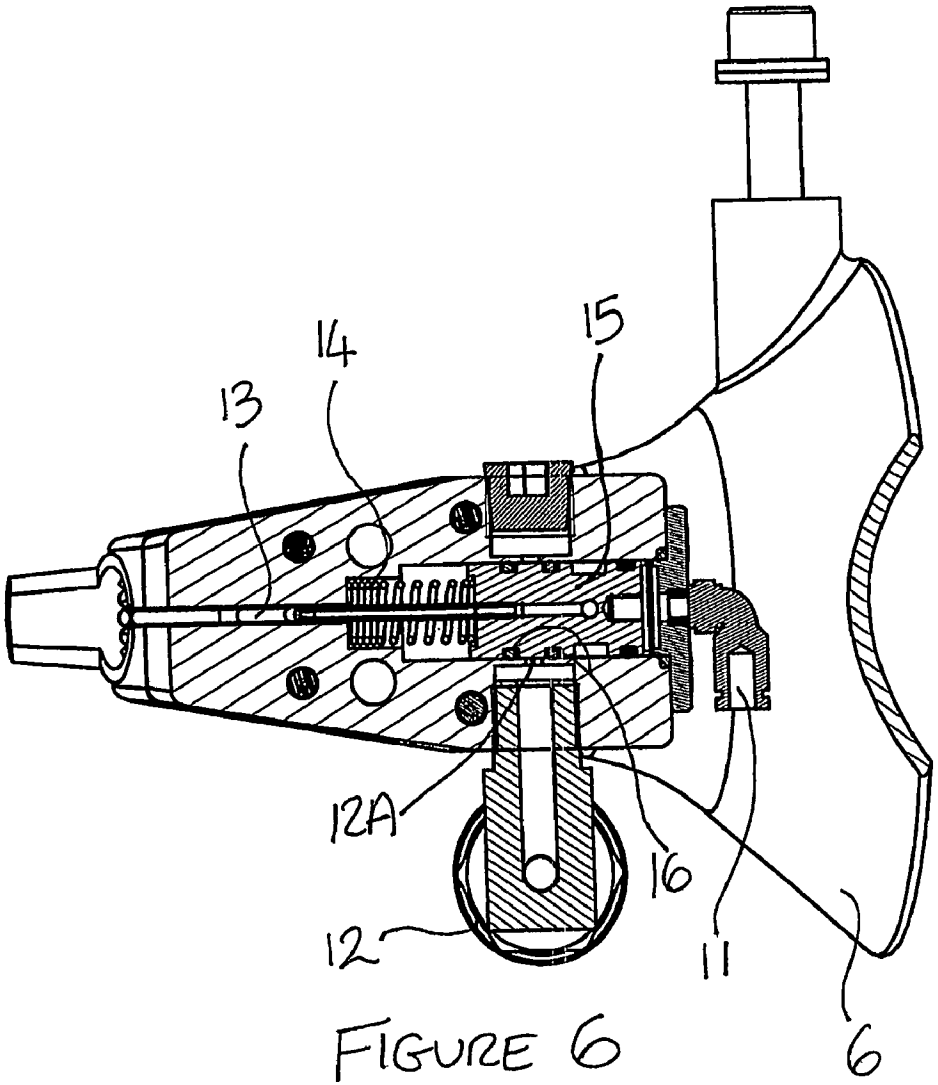
FIG. 6 is a cross-sectional top view of part of the spool valve assembly, shown in the retracted position.
Figure 7:
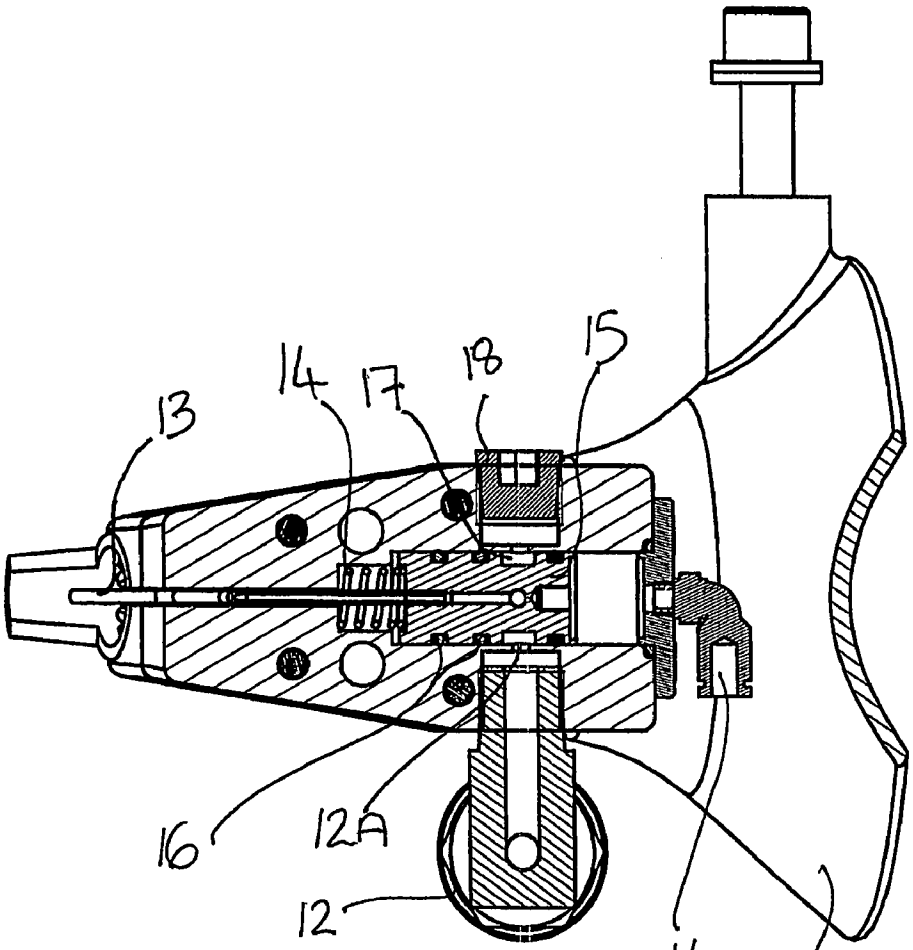
FIG. 7 is a cross-sectional top view of part of the spool valve assembly, shown in the forward position.
Figure 8:
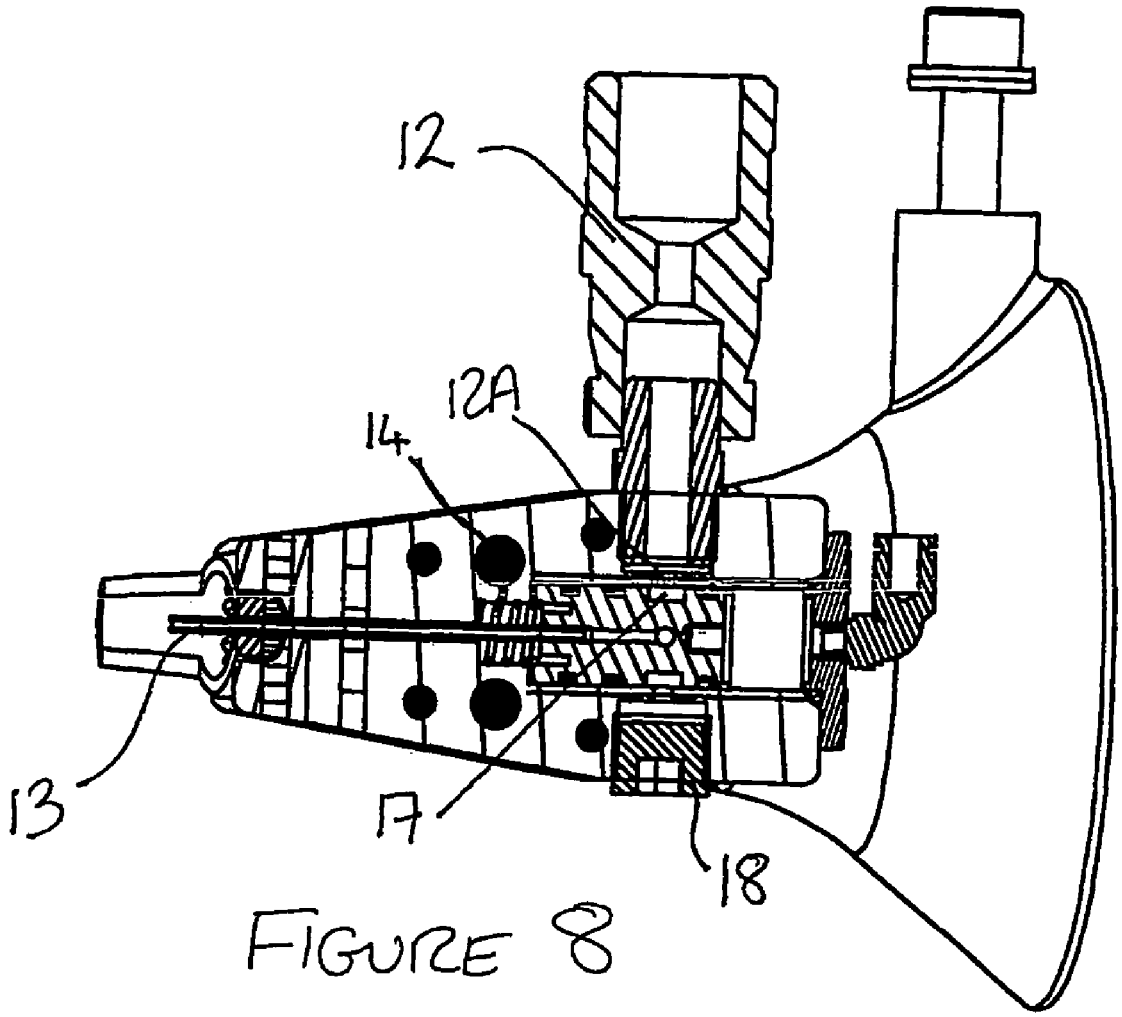
FIG. 8 is another cross-sectional view of part of the spool valve assembly, shown in the forward position, showing the flow path for the additive.

The spool valve 15 directs flavour from the flavour inlet 12 to the needle 13, as illustrated in FIGS. 6-8. FIG. 6 shows the spool valve 15 in its retracted (or closed) position. As described above, the needle 13 and spool valve 15 are retracted upstream (cf. FIG. 4). In this position, the orifice 12A of flavour inlet 12 is blocked by the spool valve 15 and sealed by the positioning of O-ring seals 16 either side thereof. Therefore, no flavour can escape from the flavour inlet into the spool valve 15 and nothing is delivered to the needle 13.

Turning now to FIGS. 7 and 8, when the needle 13 and spool valve 15 are in the forward position (cf. FIG. 5), the orifice 12A of flavour inlet 12 is now adjacent an orifice in the spool valve 15. This allows flavour to be delivered from the flavour inlet 12 via an annular undercut 17 into the spool valve 15 and then into the needle 13. The position of the distal end 13C of the needle means that flavour is delivered right into the centre of the tow.

Item 18 is a sealed plug which can be removed to allow the flavour inlet 12 to be connected to the opposite side of the apparatus, if desired.

In a preferred embodiment, some or all of the apparatus may be provided with heating means to ensure that the flavour (which may initially be supplied in solid granular or crystalline form) is kept in a liquid state during its passage through the apparatus.

The invention claimed is:

1. An apparatus for applying an additive to cigarette filter tow material which is in, or exiting, a filter tow funnel, the apparatus comprising:

a filter tow funnel;

a flavour inlet;

a valve; and a hollow needle positioned downstream of at least a portion of said filter tow funnel, the needle being controlled by said valve and in fluid communication with said flavour inlet, whereby, in use, an additive is delivered by said needle into the path of said filter tow material, characterised in that said needle is selectively moveable along a longitudinal axis which is substantially parallel to the flow path of filter tow material moving through the filter tow funnel, and this movement occurs between a forward position, in which at least the distal end of the needle is within the path of the filter tow material moving through the filter tow funnel, and a retracted position, in which said needle is not in said path.

2. The apparatus as claimed in claim 1 wherein said needle is selectively moveable between said forward and retracted positions by said valve which is pneumatically-operated.

3. The apparatus as claimed in claim 1 wherein the orifice at the distal end of the needle is in the range 0.5 mm-1.0 mm.

4. The apparatus as claimed in claim 1 further comprising heating means.

5. The apparatus as claimed in claim 1 further comprising an additive metering means for regulating the delivery of additive to the flavour inlet.

6. The apparatus as claimed in claim 1 wherein the passage of additive from the flavour inlet to the needle is controlled by said valve.

7. The apparatus as claimed in claim 1 wherein said valve is provided with one or more O-ring seals.

* * * * *